US010450949B2

(12) United States Patent
Choi

(10) Patent No.: US 10,450,949 B2
(45) Date of Patent: Oct. 22, 2019

(54) VARIABLE COMPRESSION RATIO ENGINE

(71) Applicants: Hyundai Motor Company, Seoul (KR); Kia Motors Corporation, Seoul (KR)

(72) Inventor: Myungsik Choi, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 16 days.

(21) Appl. No.: 15/826,202

(22) Filed: Nov. 29, 2017

(65) Prior Publication Data

US 2019/0112975 A1 Apr. 18, 2019

(30) Foreign Application Priority Data

Oct. 16, 2017 (KR) ..... 10-2017-0134052

(51) Int. Cl.
*F02B 75/04* (2006.01)

(52) U.S. Cl.
CPC ..... *F02B 75/045* (2013.01)

(58) Field of Classification Search
CPC ..... F02B 75/045; F02B 75/047; F02B 75/048
USPC ..... 123/48 B
See application file for complete search history.

(56) References Cited

U.S. PATENT DOCUMENTS 1,909,372 A * 5/1933 McCollum ..... F02B 75/32 123/197.1
4,174,684 A * 11/1979 Roseby ..... F01B 3/0002 123/48 B
4,517,931 A * 5/1985 Nelson ..... F02B 41/04 123/197.4
6,915,766 B2 * 7/2005 Aoyama ..... F02B 75/045 123/406.29
6,990,934 B2 * 1/2006 Sugiyama ..... F02B 75/048 123/48 B
7,100,548 B2 * 9/2006 Takahashi ..... F02B 75/048 123/197.4
7,643,930 B2 * 1/2010 Yasui ..... F01L 13/0021 123/90.15
7,669,559 B2 * 3/2010 Aoyama ..... F02D 13/023 123/48 B
7,798,109 B2 * 9/2010 Jurging ..... F02B 75/04 123/48 B
8,087,390 B2 * 1/2012 Hiyoshi ..... F02B 75/048 123/48 A
8,397,683 B2 * 3/2013 Hiyoshi ..... F02B 75/048 123/48 A (Continued)

*Primary Examiner* — Hung Q Nguyen
*Assistant Examiner* — Anthony Donald Taylor, Jr.
(74) *Attorney, Agent, or Firm* — Mintz Levin Cohn Ferris Glovsky and Popeo, P.C.; Peter F. Corless

(57) ABSTRACT

A variable compression ratio engine includes: a piston; a piston bar which is connected to the piston; a first connecting link which is connected to the piston bar through a first joint; a main body which is connected to the first connecting link through a second joint and includes a third joint and a fourth joint; a crank shaft which includes a fifth joint; a second connecting link which is connected to the main body through the fourth joint and connected to the crank shaft through the fifth joint to rotate the crank shaft; and a control link which is connected to the main body through the third joint and selectively changes a position of the third joint.

3 Claims, 5 Drawing Sheets

(56) References Cited

U.S. PATENT DOCUMENTS

| | | | | |
|---|---|---|---|---|
| 8,794,200 | B2 * | 8/2014 | Jacques | F02B 75/048 123/48 B |
| 8,844,479 | B2 * | 9/2014 | Hiyoshi | F02B 75/048 123/48 A |
| 9,784,190 | B2 * | 10/2017 | Kamada | F02D 15/02 |
| 2003/0019448 | A1 * | 1/2003 | Aoyama | F01L 1/024 123/90.16 |
| 2006/0048728 | A1 * | 3/2006 | Scalzo | F02B 75/048 123/53.1 |
| 2007/0137608 | A1 * | 6/2007 | Mizuno | F02B 75/32 123/197.4 |
| 2008/0223341 | A1 * | 9/2008 | Kamada | F02B 75/048 123/48 B |
| 2008/0283008 | A1 * | 11/2008 | Hiyoshi | F02B 75/048 123/90.17 |
| 2008/0283027 | A1 * | 11/2008 | Meintschel | F02B 75/048 123/48 B |
| 2009/0055081 | A1 * | 2/2009 | Yasui | F02B 75/048 701/103 |
| 2010/0000497 | A1 * | 1/2010 | Lee | F02B 75/048 123/48 B |
| 2010/0180868 | A1 * | 7/2010 | Scalzo | F02B 75/048 123/48 B |
| 2014/0014071 | A1 * | 1/2014 | Lee | F02B 75/047 123/48 B |
| 2014/0238356 | A1 * | 8/2014 | Woo | F02B 75/04 123/48 R |
| 2015/0219022 | A1 * | 8/2015 | Nagai | F02B 75/045 123/48 B |
| 2018/0106199 | A1 * | 4/2018 | Nakamura | F02D 15/02 |

* cited by examiner (b)

(a)

(b)

(a)

(b)

(a)

VARIABLE COMPRESSION RATIO ENGINE

CROSS-REFERENCE TO RELATED APPLICATION

This application claims under 35 U.S.C. § 119(a) the benefit of Korean Patent Application No. 10-2017-0134052 filed in the Korean Intellectual Property Office on Oct. 16, 2017, the entire contents of which are incorporated herein by reference.

BACKGROUND (a) Technical Field

The present disclosure relates to a variable compression ratio engine, and more particularly, to a variable compression ratio engine in which a compression ratio varies and cylinder deactivation is enabled.

(b) Description of the Related Art

In general, a compression ratio of an internal combustion engine refers to a ratio between a maximum volume before compression in a combustion chamber and a minimum volume after compression in the combustion chamber during a compression stroke of the internal combustion engine.

An output of the internal combustion engine is increased as the compression ratio of the internal combustion engine is increased. However, if the compression ratio of the internal combustion engine is too high, a so-called knocking phenomenon occurs, and as a result, an output of the internal combustion engine deteriorates, and overheating of the internal combustion engine, a breakdown of a valve or a piston of the internal combustion engine, and the like are caused. Therefore, the compression ratio of the internal combustion engine is set to a particular value within an appropriate range before the knocking phenomenon occurs.

However, various methods of varying the compression ratio of the internal combustion engine have been proposed because fuel economy and an output of the internal combustion engine may be improved by appropriately changing the compression ratio in accordance with a load of the internal combustion engine.

The above information disclosed in this Background section is only for enhancement of understanding of the background of the disclosure and therefore it may contain information that does not form the prior art that is already known in this country to a person of ordinary skill in the art.

SUMMARY

The present disclosure provides a variable compression ratio engine in which a compression ratio varies in accordance with an operating condition.

The present disclosure also provides a variable compression ratio engine in which cylinder deactivation is enabled, thereby improving fuel economy.

An exemplary embodiment of the present disclosure provides a variable compression ratio engine including: a piston; a piston bar which is connected to the piston; a first connecting link which is connected to the piston bar through a first joint; a main body which is connected to the first connecting link through a second joint and includes a third joint and a fourth joint; a crank shaft which includes a fifth joint; a second connecting link which is connected to the main body through the fourth joint and connected to the crank shaft through the fifth joint to rotate the crank shaft; and a control link which is connected to the main body through the third joint and selectively changes a position of the third joint.

A distance between the first joint and the second joint may be equal to a distance between the second joint and the third joint.

The control link may control the third joint so that the third joint moves along a preset control line, and the control line may be a line that connects a position of the third joint at a preset maximum stroke of the engine with a preset control point at a position closer to the piston than a position of the first joint when the piston is positioned at a top dead center at the preset maximum stroke of the engine.

In a preset cylinder deactivation mode, the control link may move a position of the third joint so that the position of the third joint coincides with the control point.

According to the variable compression ratio engine according to the exemplary embodiment of the present disclosure, an air amount may be controlled by a stroke of the piston, and as a result, it is possible to improve a performance at a high load, and reduce a pumping loss at a low load.

According to the variable compression ratio engine according to the exemplary embodiment of the present disclosure, a load of the engine may be controlled by a stroke instead of a throttle, and as a result, it is possible to increase pressure in a manifold, and thus reduce a pumping loss.

According to the variable compression ratio engine according to the exemplary embodiment of the present disclosure, cylinder deactivation is enabled, and as a result, it is possible to reduce a piston friction, and improve fuel economy.

DETAILED DESCRIPTION OF THE EMBODIMENTS

Figure 1:
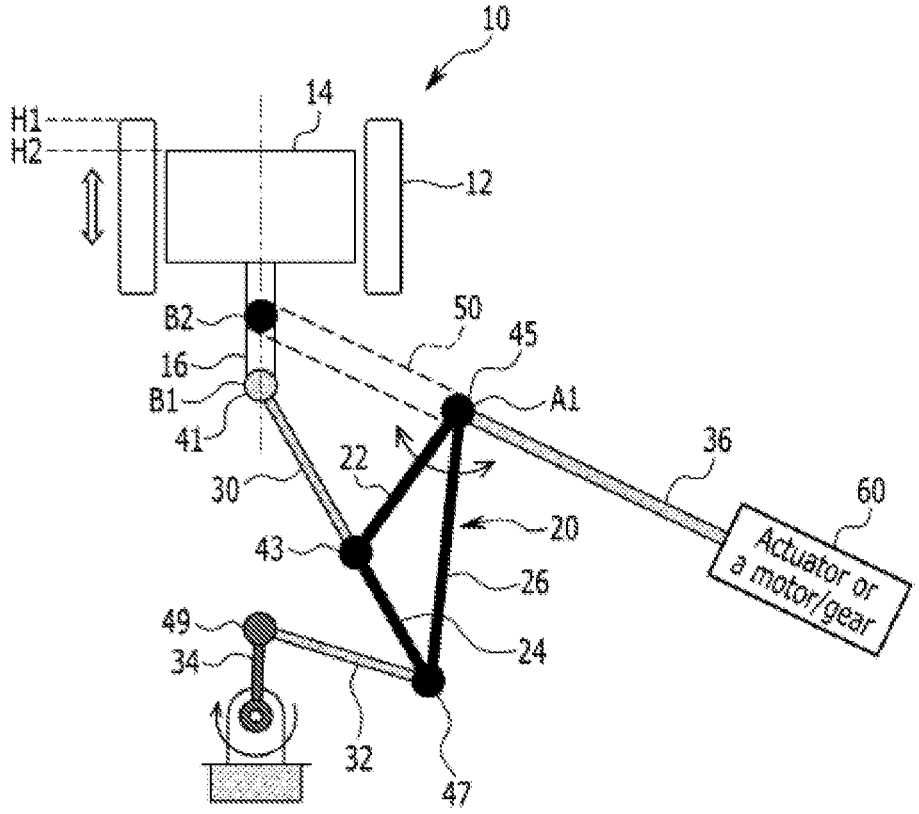
FIG. 1 is a front view of a variable compression ratio engine according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

In the following detailed description, only certain exemplary embodiments of the present disclosure have been shown and described, simply by way of illustration.

As those skilled in the art would realize, the described embodiments may be modified in various different ways, all without departing from the spirit or scope of the present disclosure.

Like reference numerals indicate like constituent elements throughout the specification.

An exemplary embodiment of the present disclosure will hereinafter be described in detail with reference to the accompanying drawings.

FIG. 1 is a front view of a variable compression ratio engine according to an exemplary embodiment of the present disclosure.

Referring to FIG. 1, a variable compression ratio engine 10 according to an exemplary embodiment of the present disclosure includes a piston 14, a piston bar 16 which is connected to the piston 14, a first connecting link 30 which is connected to the piston bar 16 through a first joint 41, a main body 20 which is connected to the first connecting link 30 through a second joint 43 and includes a third joint 45 and a fourth joint 47, a crank shaft 34 which includes a fifth joint 49, a second connecting link 32 which is connected to the main body 20 through the fourth joint 47 and connected to the crank shaft 34 through the fifth joint 49 to rotate the crank shaft 34, and a control link 36 which is connected to the main body 20 through the third joint 45 and selectively changes a position of the third joint 45. The piston 14 and the piston bar 16 may be formed integrally.

In the drawings, H1 denotes a height of a head surface, that is, a height of an uppermost end of a cylinder wall 12, and H2 denotes a top dead center (TDC) and is changed in accordance with a position of the third joint 45.

The respective joints 41, 43, 45, 47, and 49 may be configured by using connecting pins or the like, and are configured to be rotatable and pivotable. Because the functions of joints such as the respective joints 41, 43, 45, 47, and 49 are generally known, a detailed description thereof will be omitted.

A distance between the first joint 41 and the second joint 43 may be equal to a distance between the second joint 43 and the third joint 45.

For example, the main body 20 may include a first body link 22 which connects the second and third joints 43 and 45, a second body link 24 which connects the second and fourth joints 43 and 47, and a third body link 26 which connects the third and fourth joints 45 and 47, and the first connecting link 30 and the first body link 22 may have the same length.

Figure 2:
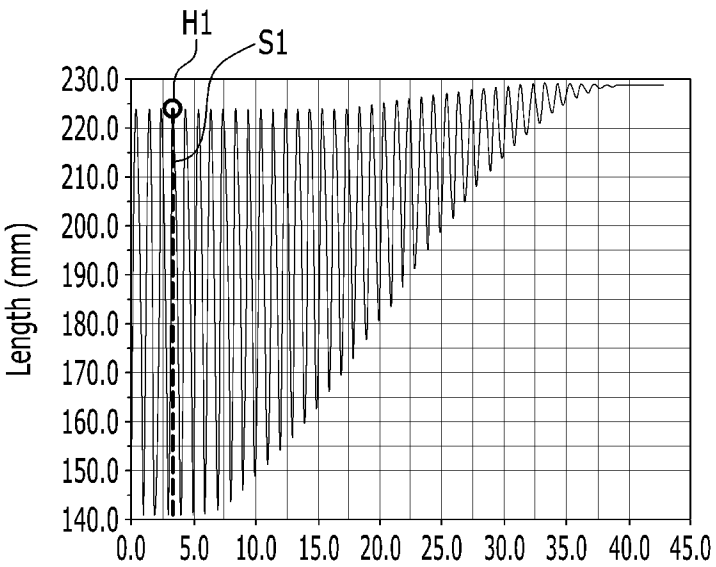
FIGS. 2 to 4 are views and graphs for explaining an operation of the variable compression ratio engine according to the exemplary embodiment of the present disclosure.
Figure 2:
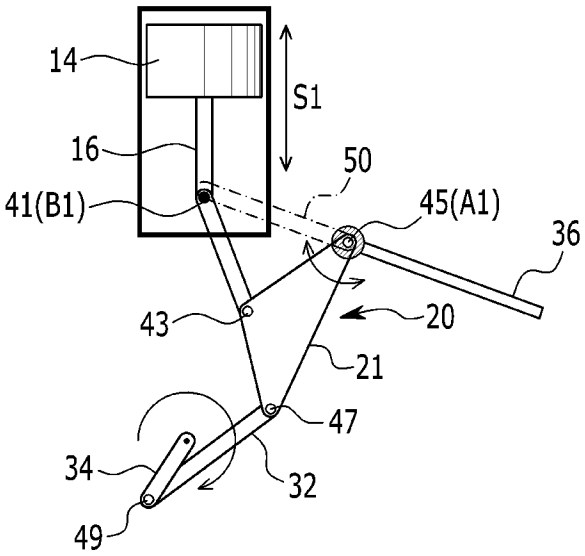
Figure 3:
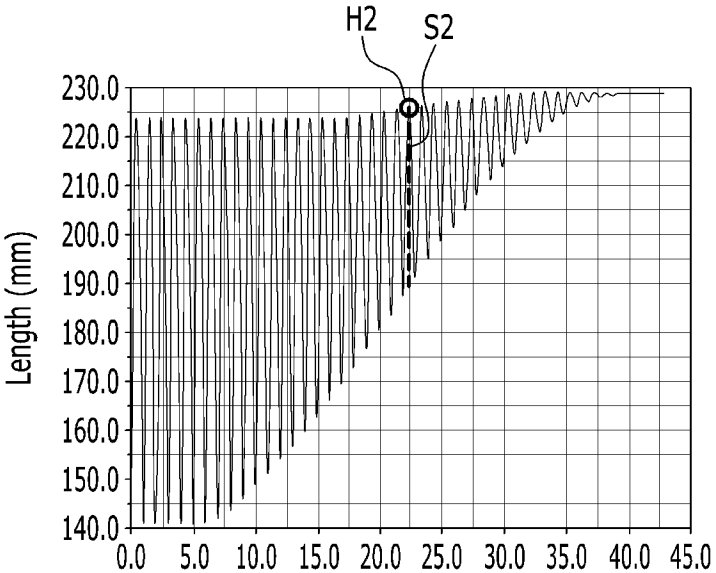
Figure 3:
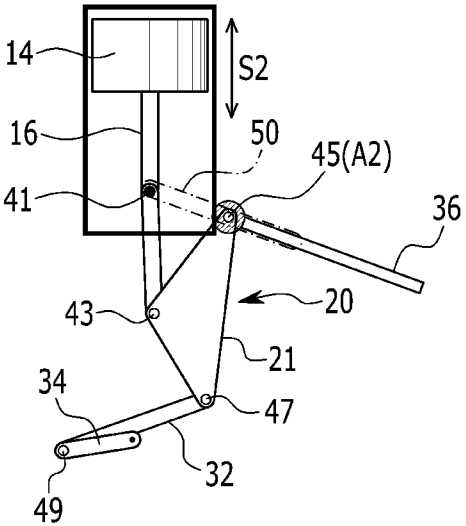
Figure 4:
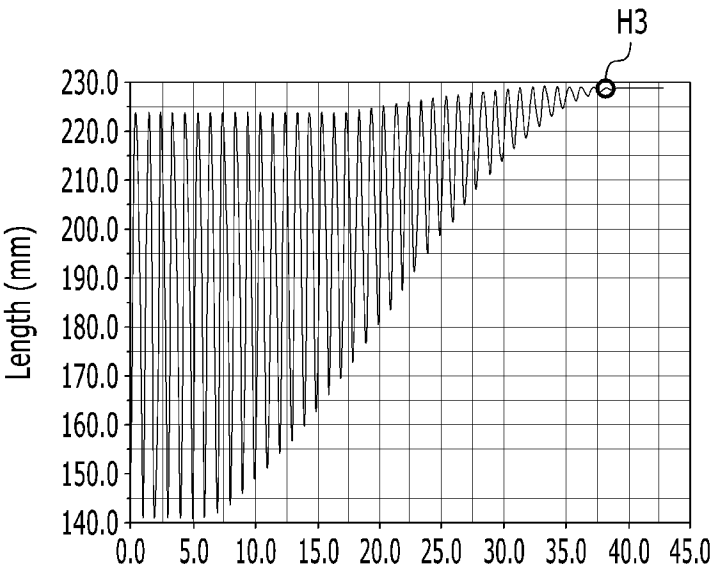
Figure 4:
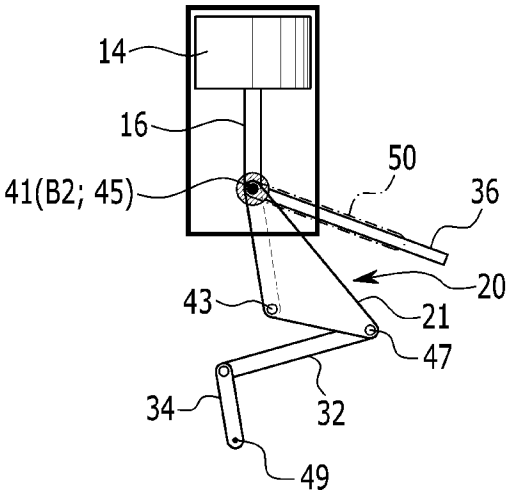

However, the configuration of the main body 20 is not limited thereto, and various shapes for connecting the second joint 43, the third joint 45, and the fourth joint 47 may be provided. For example, the main body 20 may be configured as a single plate 21 as illustrated in FIGS. 2 to 4.

The control link 36 controls the third joint 45 so that the third joint 45 moves along a preset control line 50.

The control line 50 may be an imaginary route along which the third joint 45 is moved by the movement of the control link 36, or may be a rail or a groove formed on the engine 10 in order to guide the movement of the third joint 45.

The control line 50 may be a line that connects a position Al of the third joint 45 at a preset maximum stroke of the engine 10 with a preset control point B2 at a position closer to the piston 14 than a position B1 of the first joint 41 when the piston is positioned at the top dead center at the preset maximum stroke of the engine.

In a preset cylinder deactivation mode, the control link 36 may move the position of the third joint 45 so that the position of the third joint 45 coincides with the control point B2.

The control link 36 controls the third joint 45 so that the third joint 45 is moved along the control line 50 by operation of an actuator, a motor/gear, or the like (see reference numeral 60 in FIG. 1), where the use of an actuator, motor/gear, or the like is generally known, and thus a detailed description thereof will be omitted.

In addition, the operation of the actuator, the motor/gear, or the like 60 is controlled by a controller, for example, an engine control unit (ECU), and the ECU determines an operating state of a vehicle by receiving information about operating states of the vehicle which are outputted from an accelerator opening degree sensor, a vehicle speed sensor, an air temperature sensor, an air amount sensor, and the like, and sets a position of the control link 36 based on a preset map.

FIGS. 2 to 4 are views and graphs for explaining an operation of the variable compression ratio engine according to the exemplary embodiment of the present disclosure.

Hereinafter, an operation of the variable compression ratio engine according to the exemplary embodiment of the present disclosure will be described with reference to FIGS. 1 to 4.

Referring to FIG. 2, at a maximum load of the engine, the control link 36 operates so that the third joint 45 is positioned at the preset maximum load position Al. In this case, the first joint 41 is positioned at the point B1 when the piston is positioned at the top dead center.

The piston 14 vertically and reciprocally moves, and a stroke S1 of the piston 14 is about 140 mm to 224 mm, that is, about 84 mm.

The piston bar 16 connected to the piston 14 allows the main body 20 to pivot about the third joint 45, such that the crank shaft 34, which is connected to the main body 20 through the second connecting link 32, is rotated.

Referring to FIG. 3, at an intermediate load of the engine, the control link 36 operates such that the third joint 45 is positioned at a preset position A2.

When the third joint 45 is positioned at the position A2, a stroke S2 of the piston 14 is decreased to about 190 mm to 225 mm, that is, about 35 mm.

Referring to FIG. 4, at a low load of the engine, for example, during cylinder deactivation, the control link 36 operates such that the third joint 45 is positioned at the control point B2.

When the third joint 45 is positioned at the control point B2, the position of the first joint 41 and the position of the third joint 45 coincide with each other, and a distance between the first joint 41 and the second joint 43 and a distance between the second joint 43 and the third joint 45 are equal to each other, and as a result, the stroke of the piston 14 may become "0".

That is, the stroke of the piston 14 may be continued to be about 228 mm.

As described above, the operation of the variable compression ratio engine according to the exemplary embodiment of the present disclosure has been described in respect to the maximum load of the engine, the intermediate load of the engine, and the cylinder deactivation, but the present disclosure is not limited thereto, and various strokes may be implemented in accordance with the position of the third joint 45 as shown in the stroke graphs illustrated in FIGS. 2 to 4.

Figure 5:
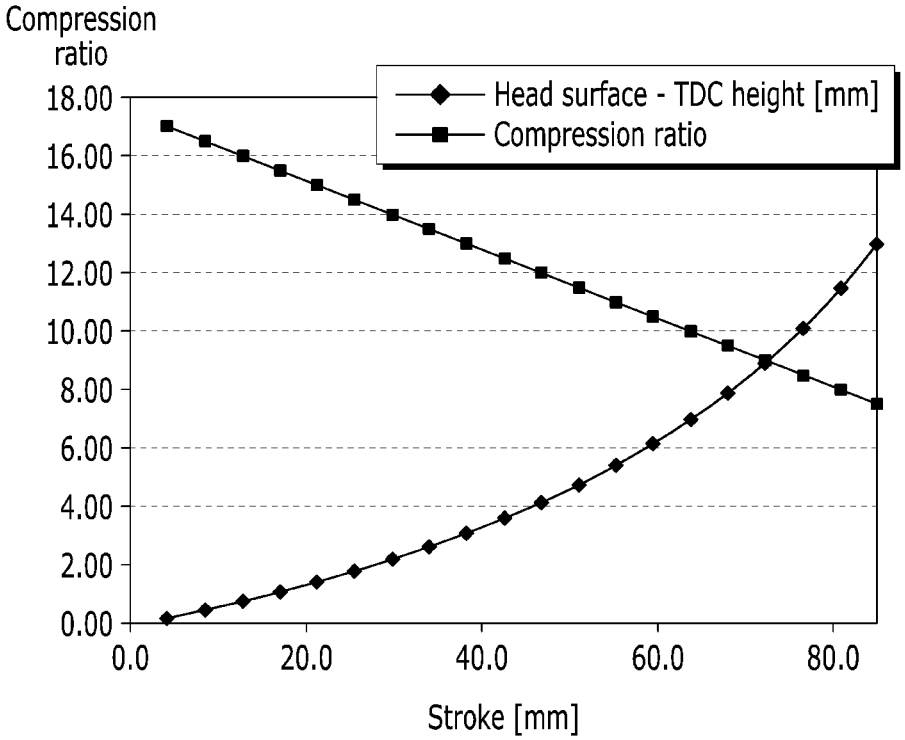
FIG. 5 is a graph illustrating a stroke and a compression ratio of the variable compression ratio engine according to the exemplary embodiment of the present disclosure.

FIG. 5 is a graph illustrating a stroke and a compression ratio of the variable compression ratio engine according to the exemplary embodiment of the present disclosure.

Hereinafter, a method of setting a compression ratio in accordance with a stroke will be described with reference to FIGS. 1 to 5.

In the variable compression ratio engine according to the exemplary embodiment of the present disclosure, the third joint 45 moves between the position Al of the third joint 45 at the preset maximum stroke and the preset control point B2 at the position closer to the piston 14 than the position B1 of the first joint 41 when the piston is positioned at the top dead center at the preset maximum stroke of the engine, and as a result, as the third joint 45 becomes closer to the control point B2, a top dead center H2 of the piston 14 is raised and a combustion chamber volume and a stroke are decreased.

FIG. 5 illustrates strokes and compression ratios of the engine, in which the compression ratio is 7.5 when the maximum stroke is 85 mm and the load is 100%, and the compression ratio is 17 when the load is 5%.

Here, the compression ratio according to the stroke is set in accordance with the following condition.

Compression ratio=Volume before compression/Volume after compression=(Displacement volume+Combustion chamber volume)/Combustion chamber volume Here, the displacement volume is calculated by "Stroke * Cross-sectional area of cylinder".

The combustion chamber volume is a sum of a combustion chamber volume of the cylinder and a combustion chamber volume of the cylinder head, and the combustion chamber volume of the cylinder head is a fixed physical quantity. Further, the combustion chamber volume of the cylinder may be calculated by "Cross-sectional area of cylinder * {Height of head surface (H1)-TDC height (H2)}.

As illustrated in FIG. 5, according to the variable compression ratio engine according to the exemplary embodiment of the present disclosure, a low compression ratio is set at a high load, and as a result, it is possible to inhibit the occurrence of knocking, and a high compression ratio may be set at a low load in order to improve combustion efficiency.

In addition, a load of the engine may be controlled by a stroke instead of a throttle, and as a result, it is possible to increase manifold pressure and reduce a pumping loss.

In addition, as illustrated in FIG. 4, the variable compression ratio engine according to the exemplary embodiment of the present disclosure enables cylinder deactivation, and as a result, it is possible to reduce a frictional loss and improve fuel economy.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A variable compression ratio engine, comprising:

a piston;

a piston bar which is connected to the piston;

a first connecting link which is connected to the piston bar through a first joint;

a main body which is connected to the first connecting link through a second joint, the main body defined by the second joint, a third joint, and a fourth joint;

a crank shaft which includes a fifth joint;

a second connecting link which is connected to the main body through the fourth joint and connected to the crank shaft through the fifth joint in order to rotate the crank shaft; and a control link which is connected to the main body through the third joint, such that the control link is configured to selectively change a position of the third joint, wherein by operation of an actuator or a motor and gear, the control link controls the third joint such that the third joint moves along a preset control line, and wherein at a preset maximum stroke of the engine, the preset control line connects the position of the third joint with a preset control point at a position closer to the piston than a position of the first joint when the piston is positioned at a top dead center at the preset maximum stroke of the engine.

2. The variable compression ratio engine of claim 1, wherein:

a distance between the first joint and the second joint is equal to a distance between the second joint and the third joint.

3. The variable compression ratio engine of claim 1, wherein:

in a preset cylinder deactivation mode, the control link controls the third joint such that the position of the third joint coincides with the preset control point.

* * * * *